US007347541B2

(12) United States Patent
Ogawa et al.

(10) Patent No.: US 7,347,541 B2
(45) Date of Patent: Mar. 25, 2008

(54) LIQUID TANK

(75) Inventors: Masashi Ogawa, Mishima (JP); Wataru Takahashi, Kawasaki (JP); Tatsuo Nanjo, Kawasaki (JP); Yasuo Kotaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 348 days.

(21) Appl. No.: 11/140,327

(22) Filed: May 27, 2005

(65) Prior Publication Data

US 2005/0264621 A1 Dec. 1, 2005

(30) Foreign Application Priority Data

Jun. 1, 2004 (JP) ..... 2004-162957

(51) Int. Cl.
*B41J 2/175* (2006.01)

(52) U.S. Cl. ..... 347/86

(58) Field of Classification Search ..... 347/85, 347/86, 87; 141/2, 7, 18
See application file for complete search history.

(56) References Cited

U.S. PATENT DOCUMENTS 5,509,140 A 4/1996 Koitabashi et al.
6,058,984 A * 5/2000 Sato ..... 141/7
6,137,512 A 10/2000 Higuma
6,206,514 B1 3/2001 Tajima
6,270,206 B1 * 8/2001 Shimizu et al. ..... 347/86
6,474,798 B1 * 11/2002 Shinada et al. ..... 347/86
6,502,931 B2 1/2003 Udagawa et al.

FOREIGN PATENT DOCUMENTS

JP 6-328710 A 11/1994
JP 8-20115 A 1/1996
JP 10-24603 A 1/1998
JP 11-342628 A 12/1999
JP 2000-33715 A 2/2000

* cited by examiner

*Primary Examiner*—Anh T. N. Vo
(74) *Attorney, Agent, or Firm*—Canon U.S.A. Inc I.P. Div

(57) ABSTRACT

A liquid tank includes a liquid chamber for holding liquid and an absorption chamber containing an absorber for absorbing and holding the liquid. The liquid chamber and the absorption chamber are separated by a partition. The partition has a communication part allowing communication between the liquid chamber and the absorption chamber. The liquid chamber is substantially sealed except at the communication part. The absorption chamber has a liquid outlet and an air inlet. A liquid-guiding path is disposed on the bottom surface of the liquid tank. The liquid-guiding path extends from the communication part to a point a predetermined distance away from the liquid outlet.

1 Claim, 12 Drawing Sheets

LIQUID TANK

BACKGROUND OF THE INVENTION

1. Field of the Invention

The present invention relates to an ink tank (liquid tank) for holding ink used in inkjet recording by discharging a liquid such as ink.

2. Description of the Related Art

A typical ink tank includes an ink chamber for directly holding ink and an absorption chamber for holding ink by absorbing the ink with an absorber disposed inside the absorption chamber. The ink chamber and the absorption chamber are connected via a communication hole. In such an ink tank, air is taken in from an air inlet into the absorption chamber and enters the ink chamber via the communication hole while ink in the absorption chamber is being consumed for recording. At the same time, ink is supplied from the ink chamber to the absorption chamber by gas-liquid exchange. A technology enabling high-speed recording by stabilizing and speeding up the gas-liquid exchange and thereby stabilizing the negative pressure inside the ink tank to obtain stable discharge of recording heads is disclosed in Japanese Patent No. 2951818 (corresponding to U.S. Pat. No. 5,509,140).

FIG. 16 illustrates a cross-sectional schematic view of an ink tank disclosed in Japanese Patent Laid-Open No. 2000-33715 (corresponding to U.S. Pat. No. 6,502,931). An ink tank 51 includes an ink chamber 57 for holding ink 56 and an absorption chamber 55 for storing absorbers 54*a* and 54*b*. The ink chamber 57 and the absorption chamber 55 are separated by a partition 58 having a communication hole 59.

The ink chamber 57 is sealed except for the communication hole 59. The sidewalls of the absorption chamber 55 have an air inlet 52 for taking in air to the ink tank 51 while ink is being consumed and an ink outlet 53 for supplying ink to a recording head (not shown in the drawing). The ink outlet 53 is formed at the tip of a hollow projection. A pressure contact body 62 is interposed between the ink outlet 53 and the absorber 54*b*. Inside the absorption chamber 55, the absorbers 54*a* and 54*b* are held down by ribs 60 in the vicinity of the air inlet 52. In this way, a space, i.e., a buffer chamber 61, is formed between the absorber 54*a* and the sidewall having the ink outlet 53.

When first using the ink tank 51, the ink surface 66 in the absorption chamber 55 is above the upper edge of the communication hole 59, as illustrated in FIG. 16. As the ink inside the absorbers 4*a* and 4*b* is consumed by the recording head, not shown in the drawing, the ink surface 66 is lowered. When the ink surface 66 reaches a gas-liquid exchange point 67 at the upper edge of the communication hole 59, as illustrated in FIG. 17, the ink 56 at the communication hole 59 is sucked into the absorbers 54*a* and 54*b* by capillary force. To compensate for the volume of ink sucked into the absorbers 54*a* and 54*b*, air is sent through the communication hole 59 to the ink chamber 57. Accordingly, gas-liquid exchange is carried out. During gas-liquid exchange, a flow of air, indicated by an arrow $F_A$ in the drawing, and a flow of ink, indicated by an arrow $F_I$ in the drawing, are generated.

In this way, when ink is consumed by the recording head, a volume of ink equivalent to the volume of consumed ink is supplied to the absorbers 54*a* and 54*b*, and the absorbers 54*a* and 54*b* maintain a uniform volume of ink (i.e., the level of the ink surface 66 is maintained at a predetermined height). Accordingly, the absorbers 54*a* and 54*b* maintain negative pressure in the ink tank 51 in respect to the recording head. In this way, the recording head is capable of carrying out sufficient discharge of ink.

According to the structure of the ink tank 51 illustrated in FIGS. 16 and 17, the two absorbers 54*a* and 54*b* maintain the height of the level of the ink surface 66 within the absorbers 54*a* and 54*b* and prevent air from entering the ink chamber 57 when the recording head is not used. In this way, gas-liquid exchange is carried out stably.

Such a small ink tank capable of using ink in a highly efficient manner has been commercialized by the assignee and is currently in practical use.

Japanese Patent Laid-Open No. 8-20115 (corresponding to U.S. Pat. No. 6,137,512) discloses an ink tank including absorbers made of thermal-plastic olefin-based resin. The ink tank has excellent storage stability and can be easily recycled since the chassis of the ink tank and the fiber absorber are made of similar materials.

Japanese Patent Laid-Open No. 10-24603 discloses a structure in which a groove for letting gas in from an absorption chamber to an ink changer is disposed on the bottom surface of an ink tank. The groove is provided to let gas in from an absorption chamber during gas-liquid exchange carried out when the ink surface at the inner portion of an absorber, which is where capillary force is weakest, is lowered.

Recently, the recording speed of known inkjet recording apparatuses has been increased. Along with the increase in recording speed, the inkjet recording apparatus is required to increase the volume of ink supplied per unit time from the ink tank to the recording head. If the volume of ink supplied from the ink tank is increased in the above-described ink tank, the air supply to the ink chamber or the ink supply from the ink chamber will not be able keep up with the volume of ink being consumed from the ink tank. Therefore, the level of the ink surface in the absorption chamber 55 will be lowered. As illustrated in FIG. 18, if the level of the ink surface is significantly lowered inside the absorption chamber 55, a sufficient amount of ink cannot be held in the vicinity of the ink outlet 53 even though a substantial volume of ink 56 remains inside the ink chamber 57. This lowering of the level of the ink surface must be prevented because it might result in an interruption of the ink supply to the recording head.

To increase the recording speed and improve the quality of the recorded image of known inkjet recording apparatuses, the length of the recording heads and the density of the ink discharger have been increased. When filling ink into an inkjet recording head or when operating the inkjet recording head to carry out recording, the discharge ability of the recording head is recovered by removing thickened ink from the vicinity of the ink dischargers. The removal of the thickened ink is carried out by sucking out the ink from the ink dischargers. If the length of the recording heads and the density of the ink discharger are increased, the suction action must be carried out at a higher pressure. At this time, the level of the ink surface must be prevented from lowering inside the absorption chamber. If the level of the ink surface is lowered during suction, the meniscus breaks at the surface where the absorber and the sidewall of the ink tank come into contact. As a result, air bubbles may be sucked into the recording head. Even if the meniscus does not break, the ink supply may fail.

In this way, to prevent the level of the ink surface from being lowered in the absorption chamber even when the volume of ink being supplied is increased, the distance between the ink outlet and the communication hole can be reduced, i.e., the flow resistance in the area is reduced, to improve the ability of supplying ink. However, if the distance between the ink outlet and the communication hole is reduced, for example, ink leakage may occur when the ink chamber is disposed above the absorption chamber and left untouched. In other words, the reliability of the ink tank may be reduced. The flow resistance may be reduced by reducing the density of the absorbers. However, also in such a case, the ink-holding power of the absorber is reduced and the reliability of the ink tank may be reduced.

SUMMARY OF THE INVENTION

The present invention is directed to a liquid tank for holding a liquid to be supplied to a liquid discharge head. The liquid tank is capable of providing reliable liquid-holding ability while being able to provide a large volume of liquid per unit time.

In one aspect of the present invention, a liquid tank includes an absorber configured to absorb and hold the liquid, a liquid chamber, and an absorption chamber. The absorption chamber contains the absorber, and the liquid chamber directly holds the liquid. The absorption chamber includes a liquid outlet for supplying the liquid to the liquid discharge recording head and an air inlet. The absorption chamber and the liquid chamber are separated by a partition having a communication part allowing communication between the absorption chamber and the liquid chamber. The liquid chamber is substantially sealed except at the communication part. The liquid is supplied from the liquid chamber to the absorption chamber through the communication part and an upper edge of the communication part on the side of the absorption chamber. A pressure contact body is disposed between the absorber and the liquid outlet. A liquid-guiding path guides the liquid from the liquid chamber to about the pressure contact body.

The liquid tank according to the embodiments of the present invention takes air into the liquid chamber through the communication part when liquid is supplied from the liquid tank to the recording head. At the same time, liquid is supplied from the liquid chamber to the absorption chamber by a liquid flow from the liquid chamber to the liquid outlet through the liquid-guiding path.

The liquid tank according to the embodiments of the present invention is capable of supplying liquid to the absorption chamber through the liquid-guiding path when liquid is being supplied from the liquid tank to the recording head. In this way, the level of the liquid surface inside the liquid chamber is prevented from being lowered significantly below the upper edge of the communication part. Accordingly, the liquid tank according to the embodiments of the present invention is capable of stably supplying a large volume of liquid per unit time. Since the liquid-holding power of the absorber in the absorption chamber does not have to be reduced, the liquid-holding ability of the liquid tank is not reduced.

Further features and advantages of the present invention will become apparent from the following description of exemplary embodiments (with reference to the attached drawings).

BRIEF DESCRIPTION OF THE DRAWINGS

FIG. 1 is a schematic view of an ink tank according to a first embodiment of the present invention, wherein

DESCRIPTION OF THE EMBODIMENTS

Embodiments of the present invention will be described below with reference to the drawings.

First Embodiment

Figure 1A:
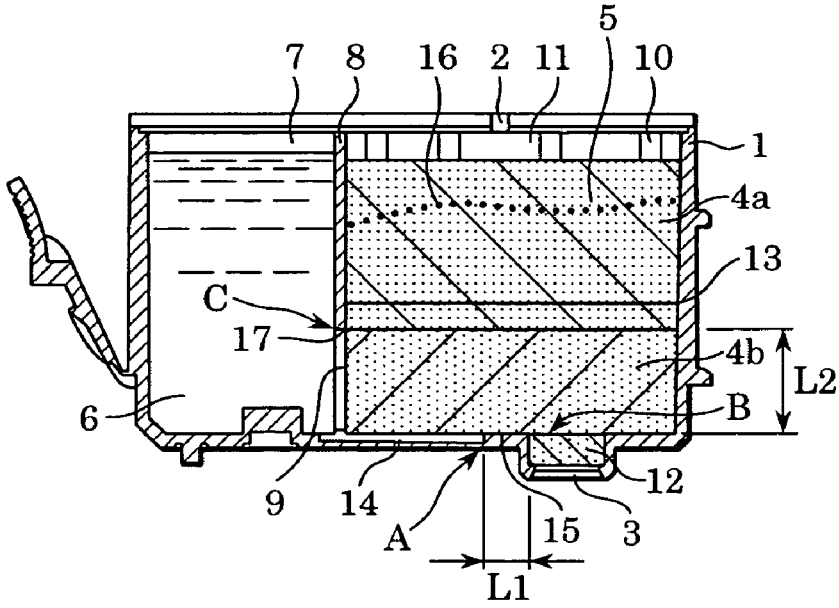
FIG. 1A is a vertical cross-sectional view and FIG. 1B is a horizontal cross-sectional view of the bottom portion.

FIG. 1 is a cross-sectional view of an inkjet cartridge, i.e., an ink tank 1, according to a first embodiment of the present invention.

The ink tank 1 according to this embodiment includes an ink chamber (liquid chamber) 7 for holding ink 6 and an absorption chamber 5 for storing absorbers 4*a* and 4*b*. The absorbers 4*a* and 4*b* disposed inside the absorption chamber 5 include many capillaries. The meniscus force of the capillaries, i.e., capillary force, generates negative pressure for absorbing and maintaining the ink 6. The absorbers 4*a* and 4*b* are also referred to as negative-pressure-generating members.

The ink chamber 7 and the absorption chamber 5 are separated by a partition 8. The ink chamber 7 and the absorption chamber 5 are connected only at a communication hole (communication part) 9 formed at the lower part of the partition 8 of the ink tank 1. The ink chamber 7 is substantially sealed except for the communication hole 9. At the upper part of the absorption chamber 5, an air inlet 2 is formed to communicate with the outside of the ink tank 1.

An ink outlet (liquid outlet) 3 for supplying the ink 6 to a recording head is formed at the bottom of the ink tank 1. The ink outlet 3 is formed at the tip of a hollow projection. A pressure contact body 12, which has a greater capillary force, i.e., force for maintaining the ink 6, compared to the capillary force of the absorbers 4*a* and 4*b*, is interposed between the ink outlet 3 and bottom of the absorber 4*b*.

A plurality of ribs 10 are provided on the upper wall of the ink tank 1 on the side of the absorption chamber 5 such that the ribs 10 protrude inward and contact the upper surface of the absorber 4*a*. In this way, a buffer chamber 11 is formed between the upper wall and the absorber 4*a*.

Various porous and fibrous materials, such as foamed polyurethane, may be used to compose the absorbers 4*a* and 4*b* so long as the material is capable of forming a structure including many capillaries. There is a wider range of selection of fibrous material compared to the range of porous materials, such as urethane. Therefore, a fibrous material having excellent wettability may be selected from fibrous materials, and thus an ink tank 1 having a significantly stable wettability is provided. As easily recyclable ink tank 1 is provided by composing the absorbers 4*a* and 4*b* with a fibrous material such as a thermal-plastic resin or the same material used for the body of the ink tank 1. Moreover, if a fibrous material having a sheath-core structure is selected, the intersecting points of the fibers in the material are sufficiently fixed and thus the ink-holding power (capillary force) of the material is stabilized. In other words, an ink tank 1 having stable ink-holding power, i.e., negative pressure, is provided.

According to this embodiment, the absorbers 4*a* and 4*b* are thermoformed from a fibrous material of olefin-based resin. The cores of the absorbers 4*a* and 4*b* are formed of polypropylene, and the sheaths are formed of polyethylene. Here, the difference in the melting points of polypropylene and polyethylene is taken into consideration to set the temperature of thermoforming between the two melting points. In other words, the temperature of thermoforming is set higher than the melting point of polyethylene and lower than the melting point of polypropylene. Accordingly, the fibrous material having the lower melting point functions as an adhesive. As a result, the intersecting points of the fibers are easily fixed together by melting the polyethylene, which constitutes the sheath and has a low melting point relative to polypropylene. In this way, an ink tank having excellent characteristics as described above is realized.

According to this embodiment, similar to the structure disclosed in Japanese Patent Laid-Open No. 2000-33715, the absorbers 4*a* and 4*b* are made of materials having different capillary forces. The absorber 4*a* is disposed above absorber 4*b*. Their boundary 13 is located above the communication hole 9.

Figure 1B:
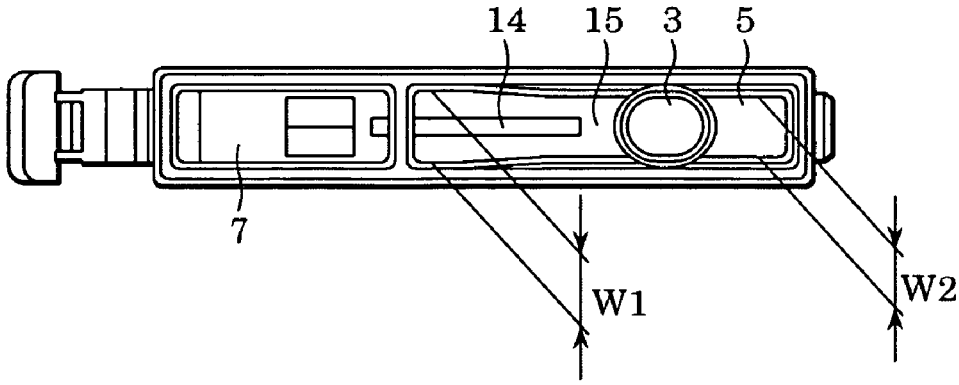

As illustrated in FIG. 1B, the width W2 of the absorption chamber 5 on the side of the ink outlet 3 is narrower than the width W1 on the side of the communication hole 9. In this way, the absorber 4*b* is strongly pressurized in the area close to the ink outlet 3 as compared to the absorber 4*a*, and thus the capillary force in the area closer to the ink outlet 3 is stronger than the capillary force in the area close to the communication hole 9. As a result, ink is smoothly supplied to the vicinity of the ink outlet 3.

According to this embodiment, an ink-guiding path (liquid-guiding path) 14, which is a substantially rectangular groove, is formed on the bottom surface of the ink tank 1. The ink-guiding path 14 extends from the bottom surface of the ink chamber 7 and below the communication hole 9 to the bottom surface of the absorption chamber 5. The ink-guiding path 14 is capable of guiding the ink 6 from the ink chamber 7 to the ink outlet 3 because the ink-guiding path 14 has a lower flow resistance as compared to the flow resistance of the absorber 4*b*.

The end A of the ink-guiding path 14 at the side of the absorption chamber 5 does not reach the pressure contact body 12 contacting the ink outlet 3. Therefore, the ink 6 is not directly sent from the ink chamber 7 to the pressure contact body 12 via the ink-guiding path 14. More specifically, the inner wall between the absorber 4*b* and the absorption chamber 5 is closely interposed between the end A of the ink-guiding path 14 and the edge B of the upper surface of the pressure contact body 12 on the side of the ink-guiding path 14 to form a sealing area 15. The sealing area 15 prevents the ink 6 from directly flowing to the ink outlet 3.

The distance of the sealing area 15, i.e., the distance L1 from the edge B of the pressure contact body 12 to the end A of the ink-guiding path 14, is shorter than the distance L2 from a horizontal plane passing through the upper edge C of the communication hole 9 on the side of the absorption chamber 5 and the upper surface of the pressure contact body 12. In other words, the flow resistance against the ink 6 flowing from the vicinity of the ink surface 16 in the absorption chamber 5 to the pressure contact body 12 is set greater than the flow resistance against the ink 6 flowing from the vicinity of the end A of the ink-guiding path 14 to the pressure contact body 12 when the level of the ink surface 16 inside the absorption chamber 5 is above the upper edge of the communication hole 9.

The distances L1 and L2 are set such that the flow resistances have a relationship as described above. To be more precise, the distances L1 and L2 should be measured from the area inside the pressure contact body 12, where an ink flow actually occurs when the ink 6 in the ink tank 1 is supplied to the recording head via the ink outlet 3, to the end A of the ink-guiding path 14 and to the ink surface 16, respectively. In actuality, the reference point on the side of the pressure contact body 12 for determining the distances L1 and L2 is affected by the structures of the absorber 4*b* and the pressure contact body 12, and the connection between the pressure contact body 12 and the recording head but, for practical use, the distances L1 and L2 can be set as described above.

Figure 2:
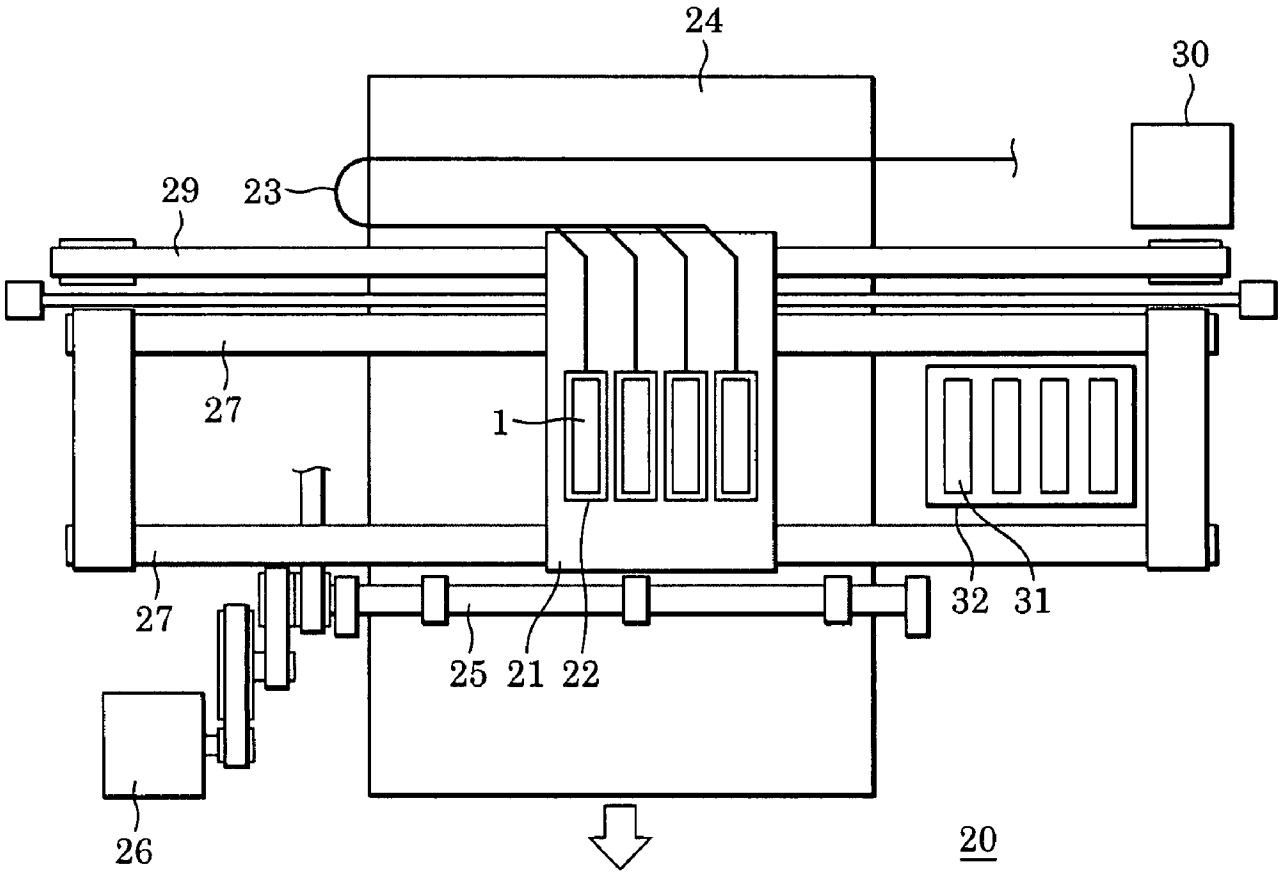
FIG. 2 is a schematic plan view of main parts of an inkjet recording apparatus including the ink tank illustrated in FIG. 1.

FIG. 2 is a schematic plan view of main parts of an inkjet recording apparatus 20 including the ink tank 1 according to this embodiment. The inkjet recording apparatus 20 includes a carriage 21 that is supported slidably along guide rails 27 and is driven by a carriage motor 30 via a driving belt 29. The carriage 21 holds, for example, four inkjet recording heads (liquid discharge recording heads) 22 for discharging four different colors of ink (black (K), cyan (C), magenta (M), and yellow (Y)). A plurality of detachable ink tanks 1 for holding the different colors of ink are disposed on the carriage 21 and are connected to the inkjet recording heads 22. The inkjet recording apparatus 20 also includes a delivery mechanism having delivery rollers 25 driven by a delivery motor 26 for delivering a recording medium 24 through a path opposing the ink discharging surface of the inkjet recording heads 22 of the reciprocating carriage 21. The delivery motor 26 and the carriage motor 30 are connected to a control unit (not shown in the drawings). The inkjet recording heads 22 are also connected to the control unit via a flexible cable 23. The control unit controls the operation of these units.

The inkjet recording apparatus 20 carries out recording operation by, first, delivering the recording medium 24 to a predetermined position and then carrying out primary scanning for selectively discharging ink in accordance with the image to be recorded by driving the inkjet recording heads 22 while reciprocating the carriage 21. The primary scanning is repeated alternately with delivery of the recording medium for a predetermined length.

The inkjet recording apparatus 20 includes a returning unit 32 that is disposed at one end of the movement path of the carriage 21 and drives the inkjet recording heads 22 to return to the opposite end. The returning unit 32 includes a cap 31 for covering the ink discharge surfaces of the inkjet recording heads 22 and for sucking ink from the ink outlets. The cap 31 is used to fill ink into the inkjet recording heads 22 when the ink tanks 1 are mounted and for returning the inkjet recording heads 22 to the end of the moving path when recording.

FIGS. 3A to 3G illustrate the movement of the ink 6 inside one of the ink tanks 1 as the ink 6 is being consumed.

Figure 3A:
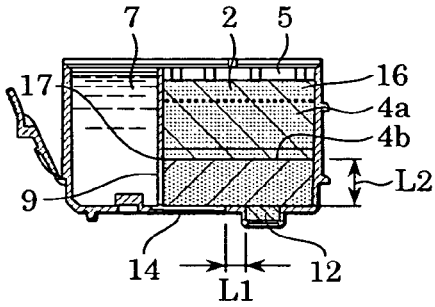
FIGS. 3A to 3G illustrate the process of consuming ink in the ink tank illustrated in FIG. 1.

FIG. 3A illustrates the inside of the ink tank 1 before a user starts operating the inkjet recording apparatus 20. Usually, before use, the absorbers 4*a* and 4*b* of the ink tank 1 are impregnated with a sufficient amount of ink 6 and the level of the ink surface 16 inside the absorption chamber 5 is in the upper absorber 4*a*. At this time, the head height of the ink in the capillaries of the absorbers 4*a* and 4*b*, when the capillaries of the absorbers 4*a* and 4*b* are regarded as being filled with ink (i.e., the "presumed head height"), is sufficiently great.

Figure 3B:
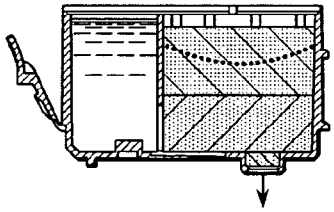

When recording is carried out, the ink is consumed by the recording head and the ink 6 in the ink tank 1 is supplied to the recording head via the ink outlet 3. Consequently, the pressure inside the absorption chamber 5 decreases and the presumed head height of the ink in the capillaries also decreases. In other words, the level of the ink surface 16 inside the absorber 4*a* is lowered as the ink 6 is consumed, as shown in FIG. 3B.

Figure 3C:
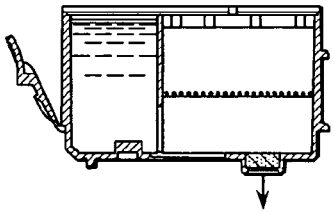

When the ink 6 inside the absorption chamber 5 continues to be consumed, the level of the ink surface 16 is lowered even more. Since the absorbers 4*a* and 4*b* are made of materials having different capillary forces, the ink 6 inside the upper absorber 4*a* is used up before the level of the ink surface 16 is lowered to the absorber 4*b*. Accordingly, the level of the ink surface 16 becomes flush with the boundary 13 between the absorbers 4*a* and 4*b*, as shown in FIG. 3C. In this way, the level of the ink surface 16 temporarily becomes horizontal without any area of the surface being significantly lower than other area of the surface.

Figure 3D:
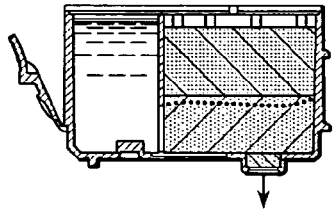

When the ink 6 inside the absorption chamber 5 is consumed even more, the ink 6 in the lower absorber 4*b* is consumed. Accordingly, the level of the ink surface 16 moves downward inside the absorber 4*b*, as shown in FIG. 3D.

Figure 3E:
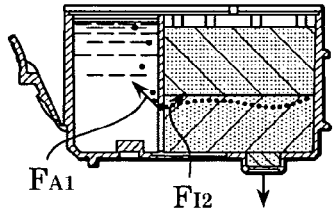

When the ink 6 inside the absorption chamber 5 is consumed further more, the level of the ink surface 16 reaches a gas-liquid exchange point 17 at the upper edge of the communication hole 9 on the side of the absorption chamber 5, as shown in FIG. 3E. Then, at the gas-liquid exchange point 17, meniscus is broken and the ink 6 inside the ink chamber 7 is sucked into the absorber 4*b* due to the negative pressure of the absorbers 4*a* and 4*b* (refer to arrow $F_{I2}$). Consequently, the pressure inside the ink chamber 7, which is a substantially sealed space, is reduced and thus air, taken into the absorption chamber 5 via the air inlet 2, is further guided to the ink chamber 7 via the communication hole 9 (refer to arrow $F_{A1}$).

Figure 3F:
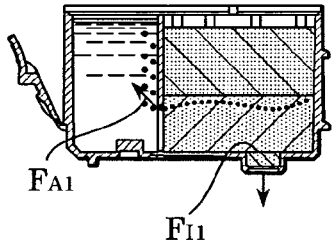

FIG. 3F illustrates the condition of the ink tank 1 when the amount of ink being supplied is increased. When the amount of ink being supplied is increased, gas-liquid exchange no longer can be carried out smoothly by using only the gas-liquid exchange point 17. Hence, the level of the ink surface 16 in the absorber 4*b* is lowered and ink is sucked in from the ink-guiding path 14 having a low flow resistance. Since the amount of ink being supplied is greater than the amount being supplied in FIG. 3E, the pressure inside the ink chamber 7 is reduced and the speed of taking in air becomes faster than the speed of supplying ink at the gas-liquid exchange point 17. The gas-liquid exchange point 17 continues to be exposed to the air through the absorbers 4*a* and 4*b* and the air inlet 2. Accordingly, an amount of air that compensates for the amount of ink supplied to the absorption chamber 5 via the ink-guiding path 14 is taken in to the ink chamber 7.

As a result, the ink 6 moves from the ink-guiding path 14 to the pressure contact body 12 before the ink 6 moves from the vicinity of the level of the ink surface 16 to the pressure contact body 12, i.e., before the ink surface 16 is lowered. In other words, at this time, the primary flow of the ink is from the ink-guiding path 14 to the pressure contact body 12, as shown in FIG. 3F, and thus, the lowering of the level of the ink surface 16 is prevented.

Figure 3G:
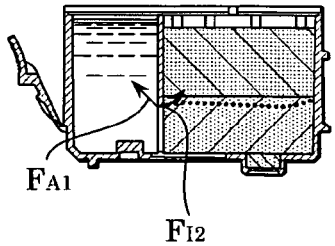

When the ink supply from the ink tank 1 to the recording head is ended, the ink supply from the ink-guiding path 14 to the ink tank 1 also is ended. Gas-liquid exchange stops when enough ink is supplied from the ink chamber 7 to the absorption chamber 5 such that there is no difference in the pressure inside the two chambers and when the level of the ink surface 16 is risen above the upper edge of the communication hole 9. At this time, the primary flow of the ink is the flow that occurs at the gas-liquid exchange point 17, as shown in FIG. 3G.

A structure of the ink-guiding path 14 is described in detail below. How to determine the distances L1 and L2 are described with reference to FIG. 4.

Figure 4:
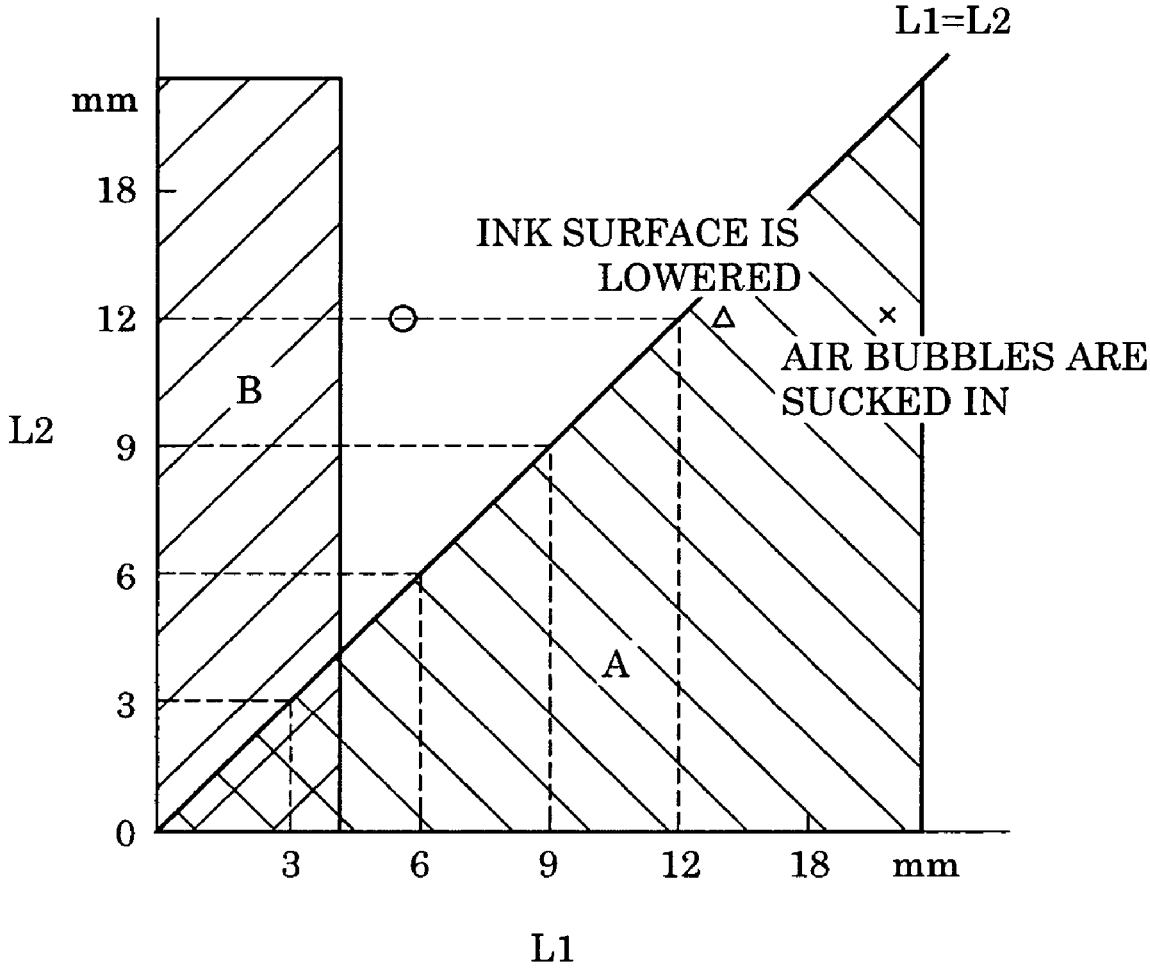
FIG. 4 illustrates the size setting of the ink guiding groove of the ink tank illustrated in FIG. 1.

In FIG. 4, region A is the region in which L1>L2. If the distances L1 and L2 are set such that they fall into this region A, when ink is continuously consumed, the ink flow from the vicinity of the ink surface 16 to the pressure contact body 12 becomes dominant compared to the ink flow from the ink-guiding path 14 to the pressure contact body 12. According to a study by the inventors, a lowering of the level of the ink surface 16 was observed when L2≈12 mm and L1≈13 mm (represented by a triangle in the graph in FIG. 4) and when the amount of ink delivered out from the ink tank 1 was increased. When L2≈12 mm and L1≈18 mm (represented by a cross in the graph in FIG. 4), the lowering of the level of the ink surface 16 was even more significant. In this case, as the amount of ink delivered out from the ink tank 1 was increased, air bubbles were sucked into the recording head. These results indicate that when the amount of ink delivered out from the ink tank 1 is significantly increased, such tendencies may be observed. Even if the distances L1 and L2 are set within region A, the lowering of the level of the ink surface 16 can be prevented to a certain extent. However, the distances L1 and L2 should be set outside region A.

According to this embodiment, to improve the ink supply to the recording head, the pressure contact body 12 is slid to pressurize the bottom surface of the absorber 4*b* when the ink tank 1 is connected to the recording head. As a result, the capillary force is increased in the absorber 4*b* in the vicinity of the pressure contact body 12, and thus ink 6 can be efficiently guided to this area with increased capillary force. Occasionally, the sliding of the pressure contact body 12 pushes up the absorber 4*b* and causes some space to be created between the bottom surface of the ink tank 1 and the bottom surface of the absorber 4*b* in the vicinity of the pressure contact body 12. Therefore, to prevent the ink chamber 7 and the pressure contact body 12 to directly communicate with each other, a relatively large width is required for the sealing area 15. In FIG. 4, region B represents the region in which sufficient width cannot be provided for the sealing area 15. The distances L1 and L2 should be set outside region B. Region B changes in accordance with the actual structure of the ink tank 1. Therefore, it is possible to reduce the area of region B, for example, by employing a structure in which the pressure contact body 12 does not slide.

According this embodiment, the distances L1 and L2 do not fall into regions A and B. In particular, since L2≈12 mm, L1 is set nearly equal to 5 mm (L1≈5 mm), to include a margin for allowing the level of the ink surface 16 to be lowered inside the absorbers 4*a* and 4*b*.

The flow resistance between the ink-guiding path 14 and the pressure contact body 12 increases when the proportion of the volume of air bubbles becomes great against the volume of ink. Therefore, the proportion of the volume of air bubbles should be reduced. Based on a study on the cross-sectional shape of the ink-guiding path 14, the width was set to about 1.8 mm and the depth was set to about 0.7 mm because if the width is set to about 1.0 mm, residual air bubbles in the ink-guiding path 14 cancels out the effectiveness of the L1<L2 relationship. The size of the ink-guiding path 14 should be determined in accordance with the actual shape of the ink tank 1.

According to this embodiment, as described above, during ink supply, the level of the ink surface 16 can be prevented from being significantly lowered below the upper edge of the communication hole 9 by guiding the ink 6 through the ink-guiding path 14 from the ink chamber 7 to the ink outlet 3, i.e., to the pressure contact body 12. In this way, a large volume of ink per unit time can be stably supplied to the recording head. According to this embodiment, the ink-guiding path 14 is provided by forming a groove in the ink tank 1 so as to stably supply a large volume of ink. Therefore, the ink-holding ability of the absorbers 4*a* and 4*b* does not have to be reduced. Accordingly, the reliability of the ink tank 1 is not reduced due to, for example, leakage of ink. Since the ink-guiding path 14 does not affect the external shape of the ink tank 1, the ink tank 1 can have the same shape as known ink tanks. For this reason, the present invention may be applied to known ink tanks to increase and stabilize the amount of ink supply.

Figure 5:
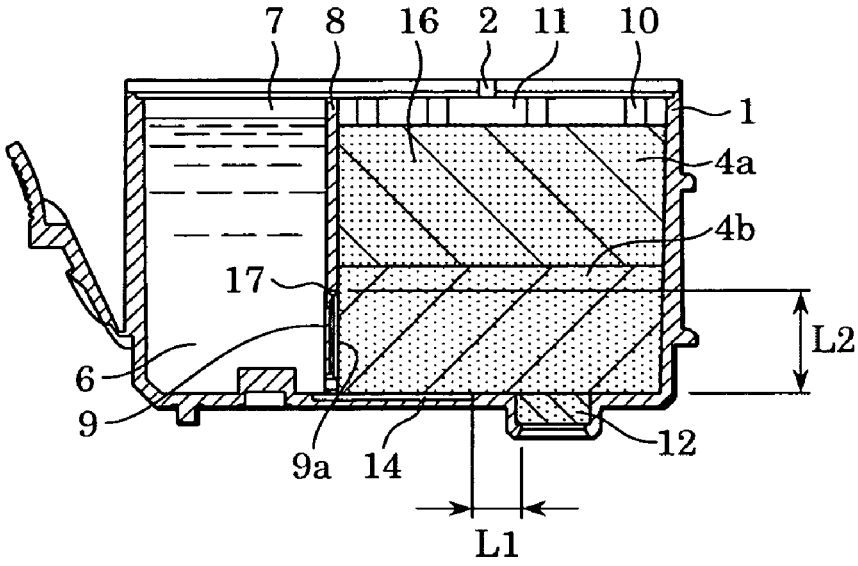
FIG. 5 is a vertical cross-sectional view of a variation of the ink tank illustrated in FIG. 1.

Various variations of the first embodiment may be included in the scope of the present invention. For example, FIG. 5 illustrates a variation of the first embodiment in which the ink-guiding path 14 according to this embodiment is provided on an ink tank 1 having a groove 9*a* extending vertically upwards on the side of the absorption chamber 5 in the vicinity of the communication hole 9, as disclosed in Japanese Patent Laid-Open No. 2000-33715 (corresponding U.S. Pat. No. 6,502,931). In this case, the distance L2 is the same distance as the distance from the pressure contact body 12 to the horizontal surface passing through the upper edge of the groove 9*a*. The distances L1 and L2 satisfies L1<L2. The ink-guiding path 14 prevents the level of the ink surface 16 to be significantly lowered below the upper edge of the groove 9*a* while supplying ink. In this way, the amount of ink supply is increased and stabilized.

According to this embodiment, the ink-guiding path 14 is formed between the bottom surface of the absorbers 4*a* and 4*b* and the inner wall of the ink tank 1, i.e., the bottom wall of the ink tank 1. However, the ink-guiding path 14 may be formed between the sidewall of the absorbers 4*a* and 4*b* and the inner wall of the ink tank 1, i.e., the sidewall of the ink tank 1.

Second Embodiment

Figure 6:
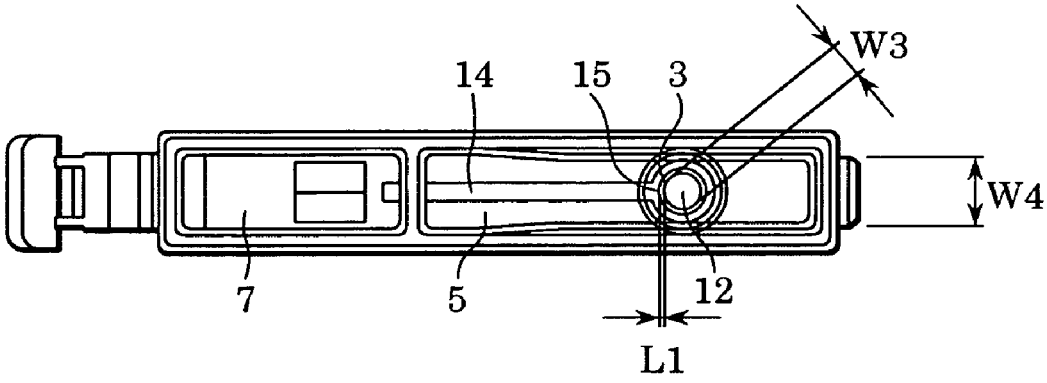
FIG. 6 is a horizontal cross-sectional view of the bottom portion of an ink tank according to a second embodiment of the present invention.

The second embodiment according to the present invention will now be described with reference to FIG. 6. FIG. 6 is a cross-sectional view of a surface contacting the ribs 10 on one side and the absorber 4*b* of the ink tank 1 on the other side. The components in the drawing that are the same as the components according to the first embodiment are represented by the same reference numerals.

According to this embodiment, the diameter W3 of the ink outlet 3 is significantly smaller than the width W4 of the ink outlet 3. The ink-guiding path 14 surrounds the entire periphery of the ink outlet 3. Even with this structure, the distance L1 between the edge of the pressure contact body 12 and the ink-guiding path 14 is sufficient, and the sealing area 15 is sufficiently large enough such that ink is directly guided from the ink-guiding path 14 to the pressure contact body 12 to prevent a decrease in the reliability of the ink-holding ability of the ink tank 1.

According to this embodiment, ink can be guided from the entire periphery of the pressure contact body 12 to the pressure contact body 12 via the ink-guiding path 14. In this way, ink can be efficiently supplied to the pressure contact body 12 while ink is consumed.

Third Embodiment

Figure 7:
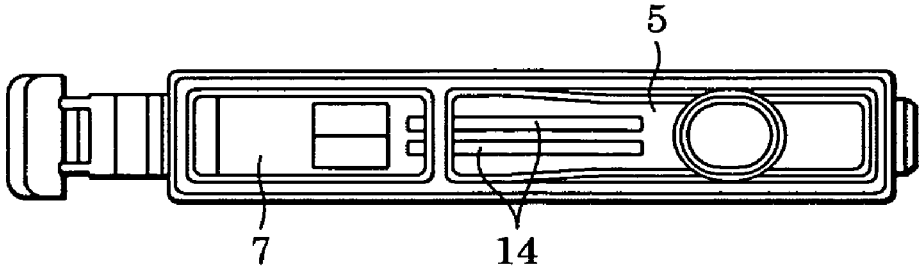
FIG. 7 is a horizontal cross-sectional view of the bottom portion of an ink tank according to a third embodiment of the present invention.

The third embodiment according to the present invention will now be described with reference to FIG. 7. FIG. 7 is a cross-sectional view of a surface contacting the ribs 10 on side and the absorber 4*b* of the ink tank 1 one the other side. The components in the drawing that are the same as the components according to the first embodiment are represented by the same reference numerals.

The ink tank 1 according to this embodiment includes a plurality of ink-guiding paths 14, as illustrated in FIG. 7. By providing the plurality of ink-guiding paths 14, the volume of ink flowing through the ink-guiding paths 14 can be maintained sufficiently large even if the width of the ink-guiding paths 14 are relatively narrow. By setting the width of the ink-guiding paths 14 relatively narrow, the bottom surface of the absorber is prevented from being pushed into the ink-guiding paths 14, causing a reduction in the cross-sectional area of the ink-guiding paths 14. In this way, a large cross-sectional area of the ink-guiding paths 14 is maintained, and an efficient ink flow is maintained for excellent ink supply.

According to this embodiment, two ink-guiding paths 14 are provided. However, the number of ink-guiding paths 14 can be set in accordance with the size and shape of the absorption chamber 5.

Fourth Embodiment

Figure 8:
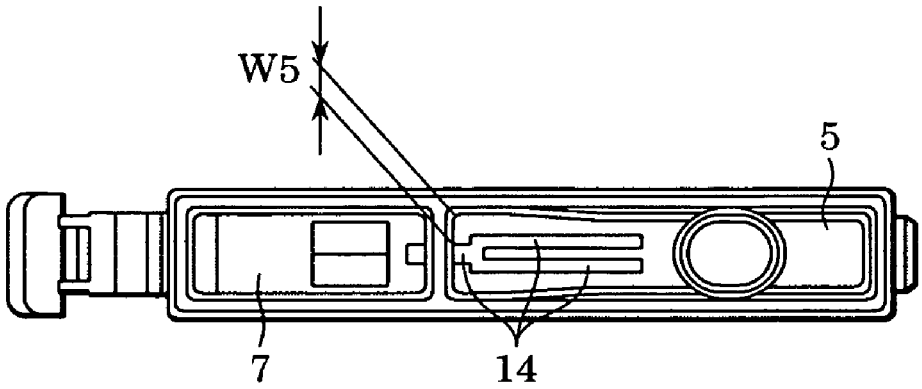
FIG. 8 is a horizontal cross-sectional view of the bottom portion of an ink tank according to a fourth embodiment of the present invention.

The fourth embodiment according to the present invention will now be described with reference to FIG. 8. FIG. 8 is a cross-sectional view of a surface contacting the ribs 10 on one side and the absorber 4*b* of the ink tank 1 on the other side. The components in the drawing that are the same as the components according to the first embodiment are represented by the same reference numerals.

According to this embodiment, a single ink-guiding path 14 branches out into a plurality of grooves (two grooves in the drawing) after reaching into the absorption chamber 5 for a predetermined distance. The absorber is prevented from being pushed into the ink-guiding path 14, where the plurality of branches is formed in a similar manner as the ink-guiding path 14 according to the third embodiment. In this way, an efficient ink flow is maintained by the large cross-sectional area of the ink-guiding path 14 and thereby an excellent ink supply is maintained.

By providing a single groove for a predetermined distance from the ink chamber 7 to absorption chamber 5 before creating branches for the ink-guiding path 14, the distance W5 from the sidewall of the absorption chamber 5 to the ink-guiding path 14 can be maintained relatively large even if the width of the ink tank 1 is relatively small. As described above, the absorption chamber 5 has a relatively large width on the side of the communication hole 9. Therefore, in this area, the contacting force between the absorber and the sidewall of the absorption chamber 5 is relatively weak. By making the distance W5 large in this area where the contacting force is relatively weak, air taken in from the air inlet 2 to the absorption chamber 5 is prevented from entering the ink-guiding path 14 through the contacting surface of the absorber and sidewall of the absorption chamber 5.

Fifth Embodiment

Figure 9:
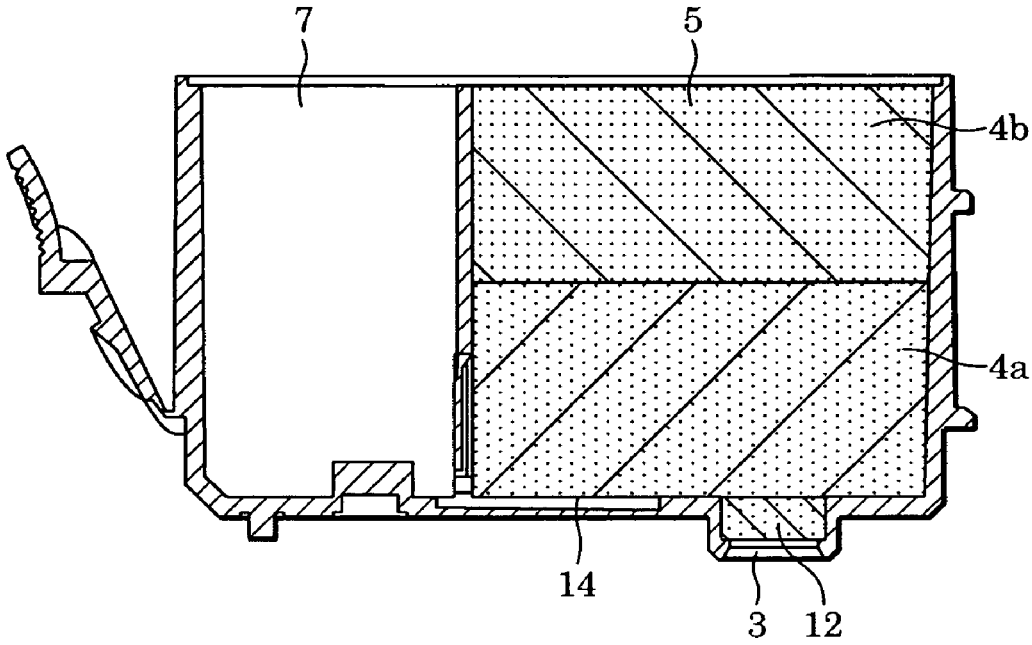
FIG. 9 is a vertical cross-sectional view of an ink tank according to a fifth embodiment of the present invention.

The fifth embodiment according to the present invention will now be described with reference to FIG. 9. FIG. 9 is a vertical cross-sectional view of the ink tank 1 according to this embodiment. The components in the drawing that are the same as the components according to the first embodiment are represented by the same reference numerals.

According to this embodiment, the depth of the ink-guiding path 14 becomes deeper towards the absorption chamber 5. When ink is being consumed, ink is supplied from the ink-guiding path 14 to the absorber 4*b*. Ink is supplied to the absorber 4*b* easier from the area close to the pressure contact body 12 than from the other areas of the ink-guiding path 14. According to this embodiment, the depth of the ink-guiding path 14 is increased and the volume of ink flow is increased in this area where the ink easily enters the absorber 4*b*. In this way, ink is supplied from the ink-guiding path 14 to the absorber 4*b* efficiently and the level of the ink surface is prevented from being lowered. The deep part of the ink-guiding path 14 functions as a buffer space for accumulating air bubbles formed by air entering into the ink-guiding path 14. In this way, a reduction in the ink flow in the ink-guiding path 14 caused by air bubbles can be prevented.

Sixth Embodiment

Figure 10:
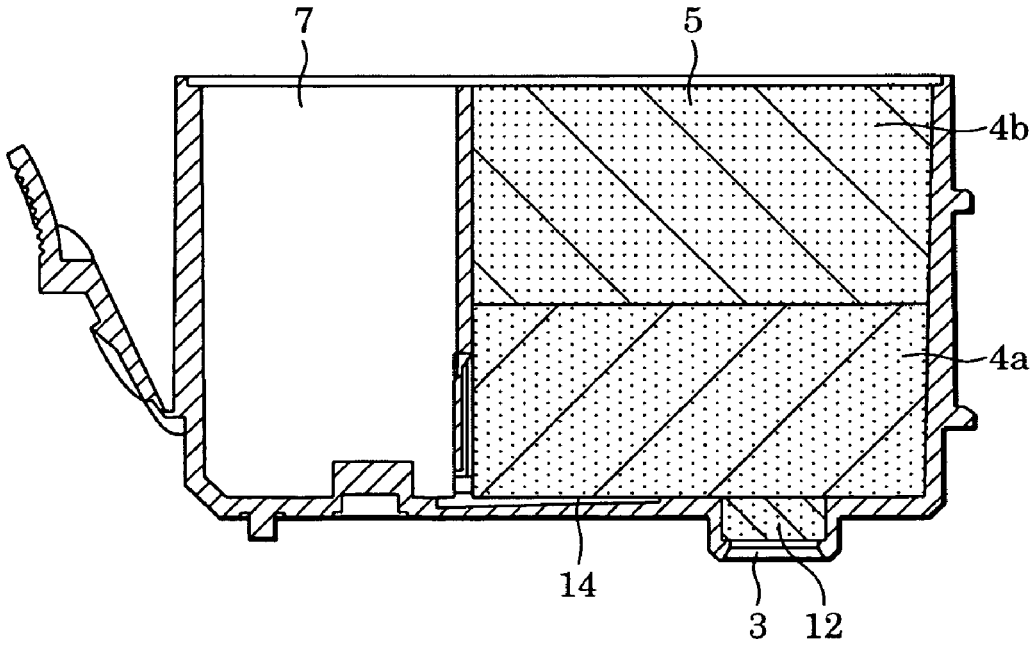
FIG. 10 is a vertical cross-sectional view of an ink tank according to a sixth embodiment of the present invention.

The sixth embodiment according to the present invention will now be described with reference to FIG. 10. FIG. 10 is a vertical cross-sectional view of the ink tank 1 according to this embodiment. The components in the drawing that are the same as the components according to the first embodiment are represented by the same reference numerals.

According to this embodiment, the depth of the ink-guiding path 14 becomes deeper towards the ink chamber 7. According to this structure, air bubbles formed inside the ink-guiding path 14 can be prevented from reaching the tip of the ink-guiding path 14 on the side of the pressure contact body 12. Moreover, ink will always be present at this tip of the ink-guiding path 14 and the ink supply to the absorber 4*b* will be carried out reliably. This structure allows air bubbles formed inside the ink-guiding path 14 to easily enter the ink chamber 7, and thus a reduction in the ink flow in the ink-guiding path 14 caused by residual air bubbles is prevented. To allow air bubbles to easily enter the ink chamber 7, the bottom surface of the absorber 4*b* may be structured such that the depth of the ink-guiding path 14 becomes shallower towards the ink chamber 7.

Seventh Embodiment

Next, the seventh embodiment of the present invention will be described.

According to this embodiment, the ink tank 1 is structured such that the surface tensions of the ink-guiding path 14 and the other parts of the ink tank 1 are different. In other words, the surface of the ink-guiding path 14 is processed to obtain, for example, a hydrophilic surface. In this way, the ink-filling ability of the ink-guiding path 14 is improved. The processing of the surface is not limited to hydrophilic processing and may be any type of processing so long as the surface of the ink-guiding path 14 and the other parts of the ink tank 1 have different surface tensions.

Eighth Embodiment

Figure 11:
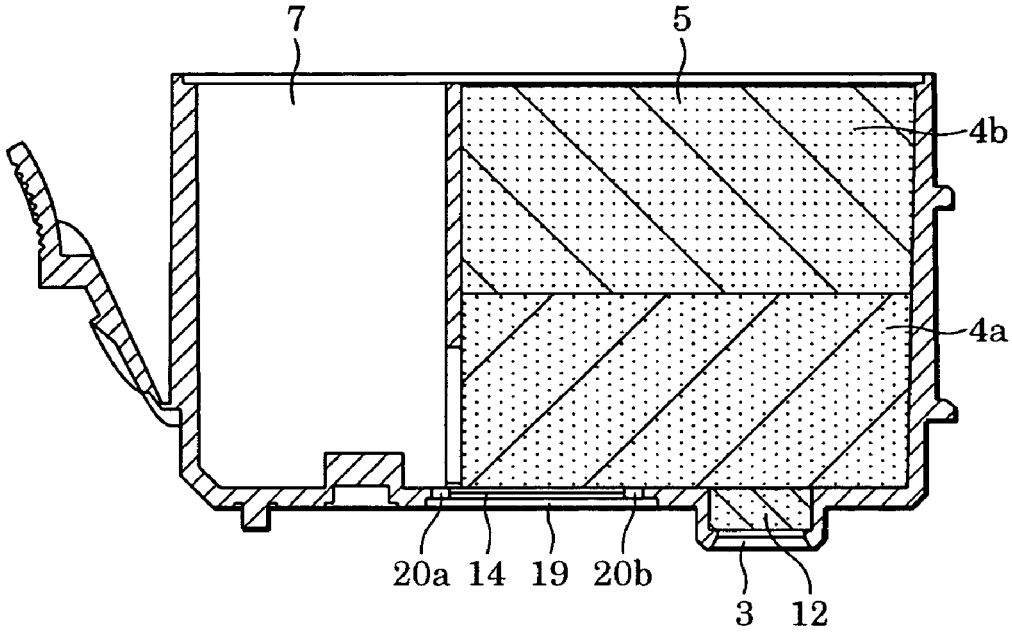
FIG. 11 is a vertical cross-sectional view of an ink tank according to an eighth embodiment of the present invention.

The eighth embodiment according to the present invention will now be described with reference to FIG. 11. FIG. 11 is a vertical cross-sectional view of the ink tank 1 according to this embodiment. The components in the drawing that are the same as the components according to the first embodiment are represented by the same reference numerals.

According to this embodiment, the ink-guiding path 14 is made of an ink-guiding path member 19 which is composed of a material different from the ink tank 1 body. The ink-guiding path member 19 is joined with the bottom surface of the ink tank 1 body. One end of the ink-guiding path 14, which is formed by joining the ink-guiding path member 19 with the ink tank 1 body, communicates with the ink chamber 7 through an opening 20*a*. The other end of the ink-guiding path 14 communicates with the absorption chamber 5 through an opening 20*b*.

According to this structure, by composing the ink-guiding path member 19 with a material different from the ink tank 1 body, the surface tension of the ink-guiding path 14 can be changed relatively easily as compared to the other parts in the ink tank 1. Accordingly, as described above in the seventh embodiment, the ink-filling ability of the ink-guiding path 14 can be improved. According to the structure of the embodiment, the upper surface of a portion of the ink-guiding path 14 located below the absorber 4*b* is covered with the same material as the ink-guiding path member 19 or the ink tank 1 body, except for the openings 20*a* and 20*b*. In this way, the effective cross-sectional area of the ink-guiding path 14 is prevented from being reduced by the absorber 4*b* falling into the ink-guiding path 14.

Ninth Embodiment

Figure 12:
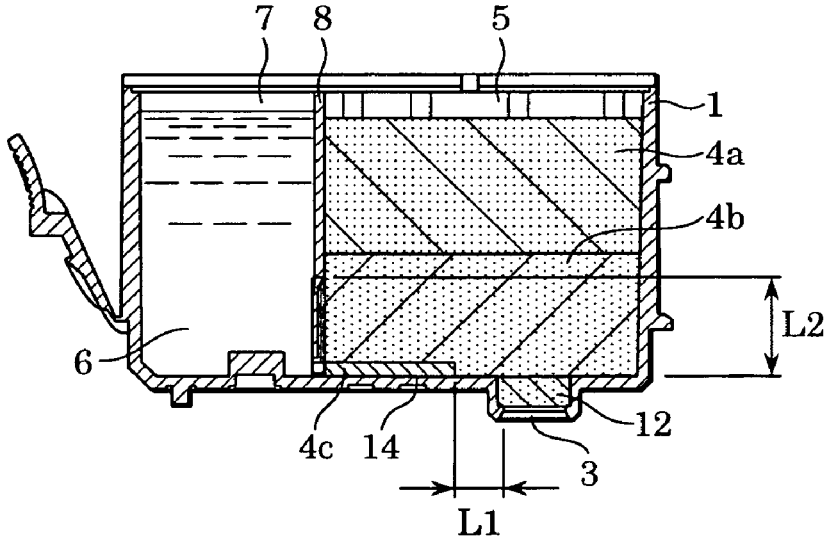
FIG. 12 is a vertical cross-sectional view of an ink tank according to a ninth embodiment of the present invention.

The ninth embodiment according to the present invention will now be described with reference to FIG. 12. FIG. 12 is a vertical cross-sectional view of the ink tank 1 according to this embodiment. The components in the drawing that are the same as the components according to the first embodiment are represented by the same reference numerals.

According to this embodiment, the ink-guiding path 14 includes an absorber 4*c* having a smaller flow resistance compared to the absorber 4*b*. According to this embodiment, the distance L1 between the pressure contact body 12 and the tip of the ink-guiding path 14 on the side of the pressure contact body 12 is set to an appropriate distance that is smaller than the distance L2, in a similar manner for setting the distances L1 and L2 according to the first embodiment.

When ink is consumed, ink is supplied by an ink flow towards the ink outlet 3, i.e., toward the pressure contact body 12, through the ink-guiding path 14. In this way, the level of the ink surface is prevented from being significantly lowered below the communication hole 9.

Figure 13:
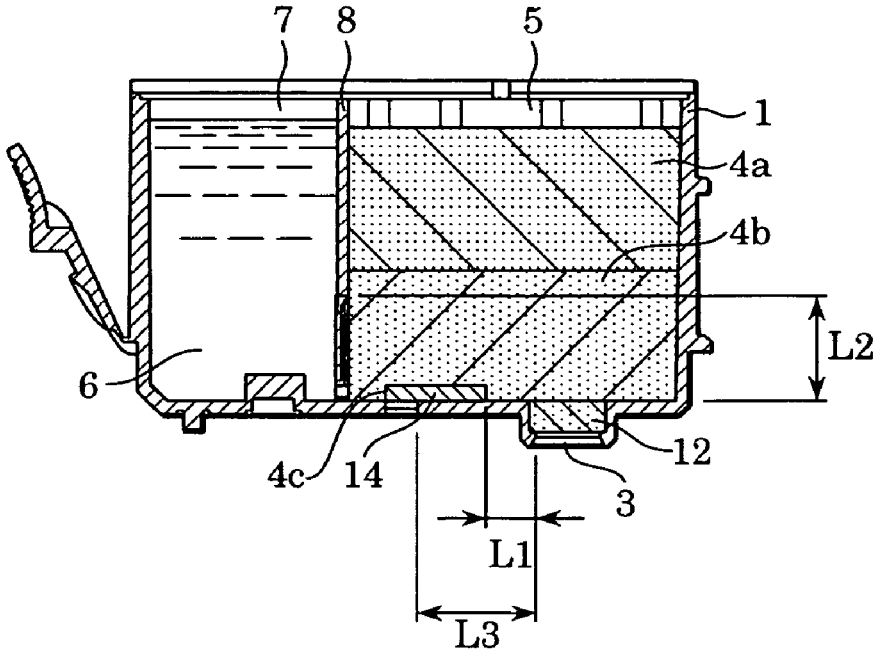
FIG. 13 is a vertical cross-sectional view of a variation of the ink tank illustrated in FIG. 12.

The ink-guiding path 14, as shown in FIG. 13, may be constituted of a combination of a groove, as described in the first to eight embodiments, and the absorber 4*c* having a low flow resistance. As illustrated in FIG. 13, the ink tank 1 having a structure according to this embodiment includes a groove extending from the ink chamber 7 to the inside of the absorption chamber 5. Furthermore, the absorber 4*c* is disposed above the vicinity of the tip of the groove on the side the pressure contact body 12. In this way, the ink-guiding path 14 extends from the ink chamber 7, passes through the groove, and reaches the absorber 4*c*. Even if the distance L3 from the pressure contact body 12 to the edge of the groove on the side of the pressure contact body 12 is not smaller than L2, as described above, so long as the distance L1 from the pressure contact body 12 to the edge of the absorber 4*c* on the side of the pressure contact body 12 is smaller than L2, the ink flow through the ink-guiding path 14 becomes dominant, as described in the first embodiment. Therefore, the lowering of the level of the ink surface can be effectively prevented.

Tenth Embodiment

Figure 14:
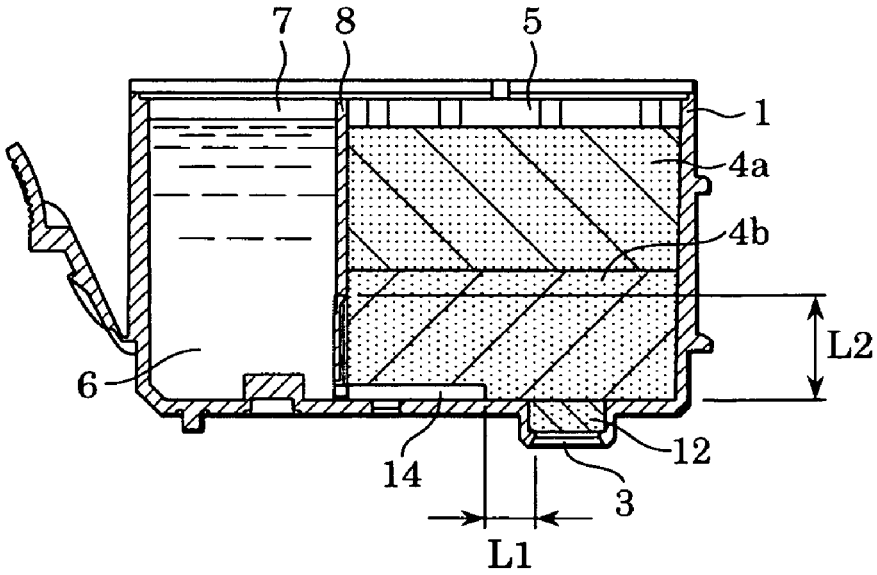
FIG. 14 a vertical cross-sectional view of an ink tank according to a tenth embodiment of the present invention.
Figure 15:
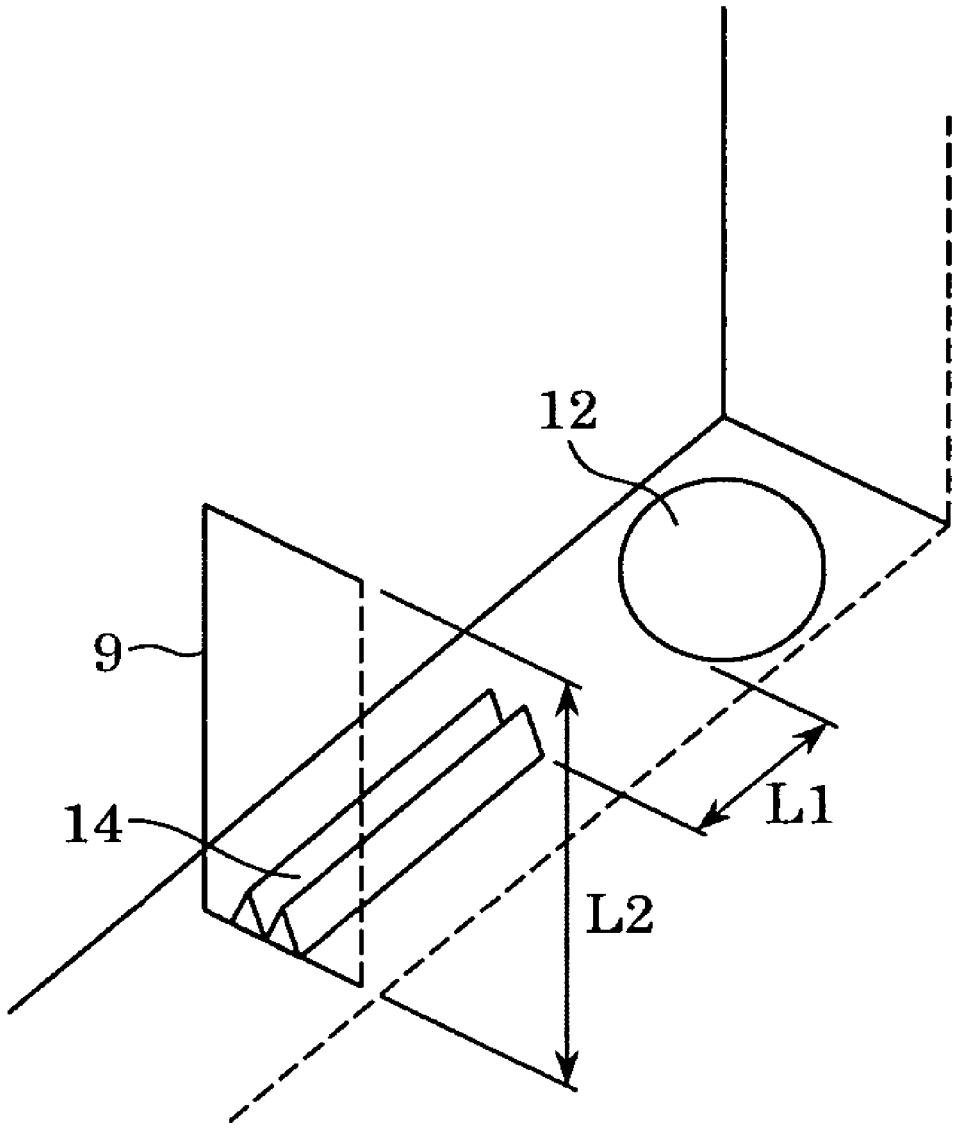
FIG. 15 is a perspective view of the bottom surface of an absorption chamber of the ink tank illustrated in FIG. 14.
Figure 16:
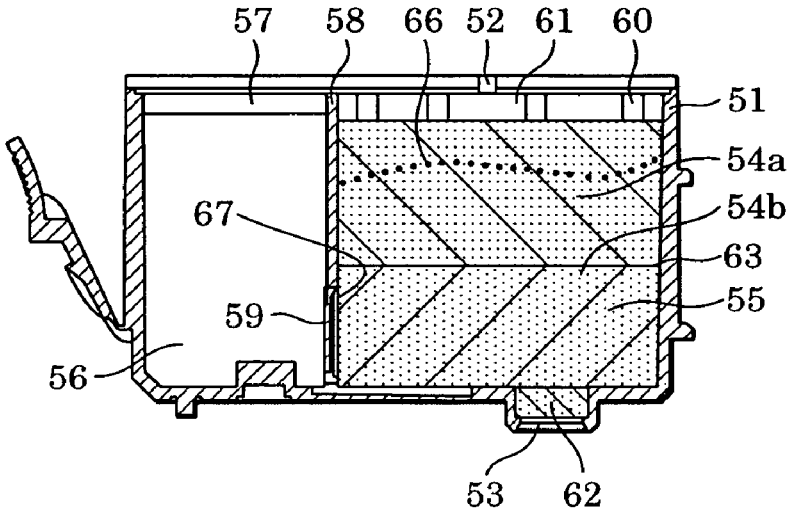
FIG. 16 PRIOR ART
FIG. 16 is a vertical cross-sectional view of a known ink tank.
Figure 17:
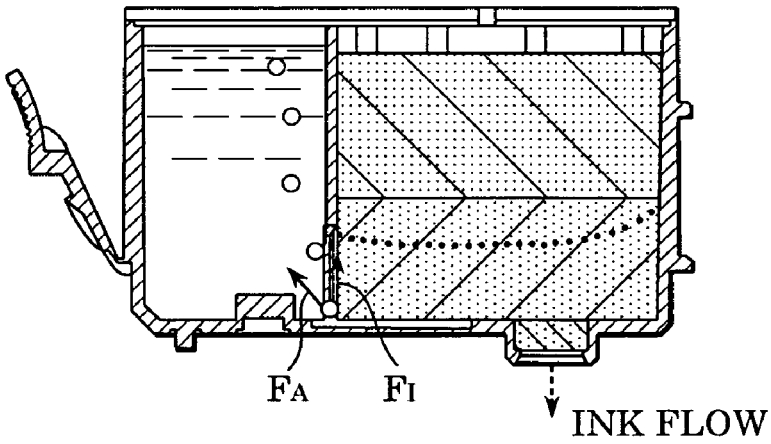
FIG. 17 PRIOR ART
FIG. 17 is a vertical cross-sectional view of the ink tank illustrated in FIG. 16 in another condition.
Figure 18:
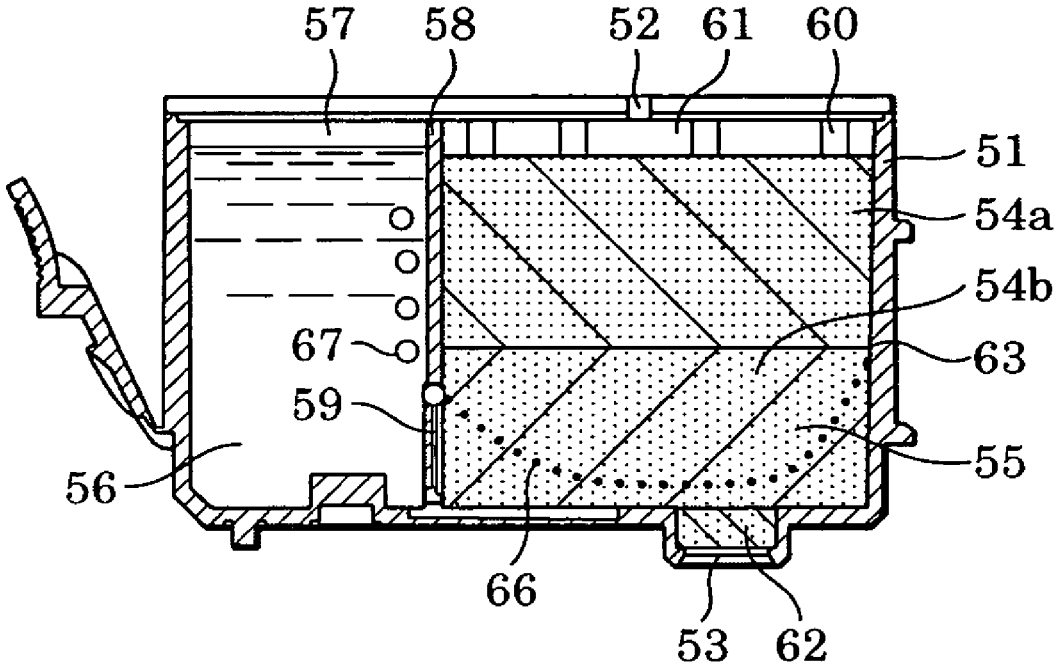
FIG. 18 PRIOR ART
FIG. 18 is a vertical cross-sectional view of the ink tank illustrated in FIG. 16 in another condition.

The tenth embodiment according to the present invention will now be described with reference to FIGS. 14 and 15. FIG. 14 is a vertical cross-sectional view of the ink tank 1 according to this embodiment, and FIG. 15 is a perspective view of the bottom surface of the absorption chamber 5 of the ink tank 1 with the absorbers 4*a* and 4*b* removed. The components in the drawing that are the same as the components according to the first embodiment are represented by the same reference numerals.

According to this embodiment, the ink-guiding path 14 is formed in the periphery of a protrusion disposed on the bottom surface of the ink tank 1. In other words, by disposing the protrusions on the bottom surface of the absorption chamber 5, the absorber 4*b* is deformed by the protrusion when disposed inside the absorption chamber 5 and a space is formed around the protrusions. According to this embodiment, this space functions as an ink-guiding path. As illustrated in FIG. 15, the protrusion may be two parallel projections extending from the communication hole 9 to the pressure contact body 12. In this case, the space between the two projections functions effectively as an ink-guiding path.

As a variation of this structure, the bottom surface of the absorber 4*b* may be formed with a depression in advance to form a space between the absorber 4*b* and the absorption chamber 5, and this space may function as an ink-guiding path.

According to this embodiment, it is also possible to form a protrusion on the inner sidewall of the absorption chamber 5 or on the side surface of the absorber 4*b* to form an ink-guiding path on the sidewall of the ink tank 1.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-162957 filed Jun. 1, 2004, which is hereby incorporated by reference herein.

What is claimed is:

1. A liquid tank comprising:

a liquid outlet configured to supply a liquid to a liquid discharge recording head;

an air inlet;

an absorption chamber containing an absorber absorbing and holding the liquid;

a liquid chamber directly holding the liquid supplied to the absorption chamber; and the liquid outlet including a pressure contact body having a stronger holding power than the absorber on liquid in contact with the absorber, wherein the absorption chamber and the liquid chamber are separated by a partition having a communication part allowing communication between the absorption chamber and the liquid chamber and the liquid is supplied from the liquid chamber to the absorption chamber through the communication part and then through an upper edge of the communication part on a side of the absorption chamber, wherein a path configured in a concave/convex form is provided to the side having the liquid outlet, the path is provided throughout the area from inside the liquid chamber to the absorption chamber, wherein the position of the end of the path on a side of the absorption chamber has an area where the absorber exists so that the path and the pressure contact body do not directly communicate between an end on a side of the pressure contact body and an edge of the upper surface of the contact body on a side of the path, and wherein the path includes a member having a liquid flow resistance that is smaller than a liquid flow resistance of the absorber.

* * * * *